US008674836B2

(12) United States Patent
Ishimoto

(10) Patent No.: US 8,674,836 B2
(45) Date of Patent: Mar. 18, 2014

(54) SECURITY SYSTEM INCLUDING ABNORMALITY DETERMINATION OF ACTIVITIES OF A MONITORED PERSON AND ELECTRONIC PHOTO FRAME

(75) Inventor: Kouichi Ishimoto, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 559 days.

(21) Appl. No.: 12/898,201

(22) Filed: Oct. 5, 2010

(65) Prior Publication Data

US 2011/0080291 A1 Apr. 7, 2011

(30) Foreign Application Priority Data

Oct. 6, 2009 (JP) ..... 2009-232066

(51) Int. Cl.
*G08B 21/00* (2006.01)

(52) U.S. Cl.
USPC ..... 340/573.1; 340/506; 340/539.1

(58) Field of Classification Search
USPC ..... 340/506, 539.1–539.19, 573.1; 709/224
See application file for complete search history.

(56) References Cited

U.S. PATENT DOCUMENTS

| | | | |
|---|---|---|---|
| 7,002,463 | B2 | 2/2006 | Wakabayashi |
| 2005/0278409 | A1 | 12/2005 | Kutzik et al. |
| 2006/0055543 | A1 | 3/2006 | Ganesh et al. |
| 2006/0066448 | A1 * | 3/2006 | Berisford et al. ..... 340/504 |

FOREIGN PATENT DOCUMENTS

| | | | |
|---|---|---|---|
| EP | 1 349 128 | A2 | 10/2003 |
| EP | 1 489 573 | A1 | 12/2004 |
| EP | 1 870 864 | A1 | 12/2007 |
| GB | 2 426 851 | A | 12/2006 |
| JP | 11-66468 | A | 3/1999 |
| JP | 2001-203826 | A | 7/2001 |
| JP | 2002-251684 | A | 9/2002 |
| JP | 2005-173668 | A | 6/2005 |
| JP | 2006-172410 | A | 6/2006 |
| JP | 2007-72647 | A | 3/2007 |
| JP | 2009-77351 | A | 4/2009 |
| JP | 2009-140445 | A | 6/2009 |

OTHER PUBLICATIONS

European Examination Report dated Sep. 22, 2011 (six (6) pages).
European Search Report dated Jan. 21, 2011 (eight (8) pages).

* cited by examiner

*Primary Examiner* — Jeffery Hofsass
(74) *Attorney, Agent, or Firm* — Crowell & Moring LLP

(57) ABSTRACT

This security system includes an activity detection portion detecting an activity of a monitored person in a house, a first communication portion acquiring a detection result (information about the activity) and an abnormality determination portion determining whether or not an abnormality is happening to the monitored person on the basis of the detection result and an activity history of the monitored person in the house and determining the extent of the abnormality of the monitored person.

16 Claims, 7 Drawing Sheets

FIG.3

141

ACTIVITY/STATE PATTERN TABLE

| DETECTION TIME | DETECTION POSITION (ACTIVITY CONTENT) | NORMAL RANGE | MAXIMUM LENGTH OF STAY |
|---|---|---|---|
| 6:30 | TOILET (WAKE-UP) | ±1. 0 (HOUR(S)) | 1. 0 (HOUR(S)) |
| 6:35 | KITCHEN (BREAKFAST) | ±1. 0 (HOUR(S)) | — |
| 6:45 | BEDROOM (DRESSING) | ±1. 0 (HOUR(S)) | — |
| 7:00 | FRONT DOOR (WORK) | ±3. 0 (HOUR(S)) | — |
| 20:00 | FRONT DOOR (RETURN HOME) | ±3. 0 (HOUR(S)) | — |
| 20:10 | BATHROOM (BATH) | ±1. 0 (HOUR(S)) | 2. 0 (HOUR(S)) |
| 20:50 | KITCHEN (SUPPER) | ±1. 0 (HOUR(S)) | — |
| 21:30 | BEDROOM (TELEVISION AND SLEEP, ETC.) | ±1. 0 (HOUR(S)) | — |
| 22:00 | ELECTRICITY METER (AMOUNT OF ELECTRICITY USED PER DAY: 10 kWh) | ±3. 0 (kWh) | — |

FIG.4

142

ABNORMALITY EXTENT DETERMINATION TABLE

| CRITICAL | SERIOUS | MILD |
|---|---|---|
| STAY IN BATHROOM FOR 2 OR MORE HOURS | STAY IN TOILET FOR 1 OR MORE HOURS | CASE OF DETERMINING THAT ABNORMALITY IS HAPPENING TO MONITORED PERSON EXCEPT CRITICAL CASE AND SERIOUS CASE |
| STAY IN TOILET FOR 2 OR MORE HOURS | | |

SECURITY SYSTEM INCLUDING ABNORMALITY DETERMINATION OF ACTIVITIES OF A MONITORED PERSON AND ELECTRONIC PHOTO FRAME

BACKGROUND OF THE INVENTION

1. Field of the Invention

The present invention relates to a security system and an electronic photo frame, and more particularly, it relates to a security system and an electronic photo frame acquiring information about an abnormality of a monitored person.

2. Description of the Background Art

A system acquiring information about an abnormality of a monitored person is known in general. Japanese Patent Laying-Open No. 2002-251684 discloses a system comprising a television device and an abnormality detection device detecting an abnormality of a viewer. This system determines whether or not power is applied to the television device at a setting time previously set as time to watch television by the viewer through the abnormality detection device and determines that an abnormality is happening to the viewer when power is not applied to the television device at the setting time.

However, the system disclosed in Japanese Patent Laying-Open No. 2002-251684 determines whether or not an abnormality is happening to the viewer (monitored person) on the basis of the setting time previously set by the viewer, and hence when the setting time set by the viewer is not consistent with an actual using status of the viewer, the system cannot accurately determines whether or not an abnormality is happening to the viewer (monitored person).

In this regard, there has been proposed a television receiver capable of accurately determining an abnormality of a monitored person, as disclosed in Japanese Patent Laying-Open No. 2009-77351, for example.

Japanese Patent Laying-Open No. 2009-77351 discloses a television receiver comprising a storage portion storing information about a viewing pattern based on a viewing history of a monitored person and a control portion determining whether or not an exceptional situation (abnormality) exists. In this television receiver, the control portion determines whether or not a television program is viewed in accordance with the information about the viewing pattern, and determines that an exceptional situation (abnormality) is occurring and sends this to a terminal for a monitoring person when the television program is not viewed in accordance with the information about the viewing pattern. In this television receiver, the control portion determines whether or not an exceptional situation (abnormality) is occurring on the basis of the information about the viewing pattern based on the viewing history of the monitored person as just described, and hence the control portion can accurately determine whether or not an exceptional situation (abnormality) is occurring on the basis of information consistent with an accrual viewing status of the monitored person.

In the television receiver disclosed in Japanese Patent Laying-Open No. 2009-77351, however, the control portion determines only whether or not an exceptional situation (abnormality) is occurring while the control portion can accurately determine whether or not an exceptional situation (abnormality) is occurring, and hence the control portion cannot determine a state of an abnormality.

SUMMARY OF THE INVENTION

The present invention has been proposed in order to solve the aforementioned problems, and an object of the present invention is to provide a security system and an electronic photo frame capable of accurately determining whether or not an abnormality is happening to a monitored person and determining a state of the occurring abnormality.

A security system according to a first aspect of the present invention comprises an activity detection portion detecting an activity of a monitored person in a house, and a security device including a first communication portion acquiring information about the activity detected by the activity detection portion, and an abnormality determination portion determining whether or not an abnormality is happening to the monitored person on the basis of the information about the activity acquired through the first communication portion and an activity history of the monitored person in the house and determining the extent of the abnormality of the monitored person on the basis of the information about the activity acquired through the first communication portion.

In this security system according to the first aspect of the present invention, as hereinabove described, the abnormality determination portion determines whether or not an abnormality is happening to the monitored person on the basis of the information about the activity acquired through the first communication portion and the activity history of the monitored person in the house, whereby the security system can accurately determine whether or not an abnormality is happening to the monitored person on the basis of the activity history of the monitored person consistent with an actual activity state of the monitored person. Further, the abnormality determination portion determines the extent of the abnormality of the monitored person on the basis of the information about the activity acquired through the first communication portion, whereby the security system can determine not only that an abnormality is happening to the monitored person but also the state (extent) of the abnormality.

In the aforementioned security system according to the first aspect, the security device preferably further includes an internal storage portion storing activity pattern information including information about a time-based activity based on the activity history of the monitored person, and the abnormality determination portion is preferably formed to determine whether or not an abnormality is happening to the monitored person on the basis of the information about the activity acquired through the first communication portion and the activity pattern information and determine the extent of the abnormality of the monitored person on the basis of the information about the activity acquired through the first communication portion. According to this structure, the security system can determine whether or not an abnormality is happening to the monitored person on the basis of the information about the time-based activities, thereby accurately determining whether or not an abnormality is happening to the monitored person on the basis of information more consistent with the actual activity state of the monitored person.

In this case, the security device preferably further includes a second communication portion transmitting information to a third party previously registered other than the monitored person and a notification portion transmitting information that an abnormality is happening to the monitored person and information about the extent of the abnormality of the monitored person through the second communication portion when the abnormality determination portion determines that the abnormality is happening to the monitored person. According to this structure, the third party receiving a notification can confirm not only that an abnormality is happening to the monitored person but also the extent of the abnormality, thereby taking action depending on the occurring abnormality.

In the aforementioned structure in which the notification portion is provided, the notification portion is preferably formed to switch notified parties to which the information that an abnormality is happening to the monitored person and the information about the extent of the abnormality of the monitored person are transmitted in response to a determination result of the extent of the abnormality of the monitored person determined by the abnormality determination portion. According to this structure, the notification portion can notify the notified parties (third parties) in response to the extent of the abnormality, and hence the notified parties can take more appropriate action depending on the extent of the occurring abnormality.

In the aforementioned structure in which the notification portion is provided, the second communication portion is preferably formed to be capable of communicating with an electronic device including an external storage portion, and the external storage portion is preferably formed to store the activity pattern information through the second communication portion on the basis of free space on the internal storage portion of the security device. According to this structure, the activity pattern information can be stored in the external storage portion even if the internal storage portion of the security device does not have enough free space.

In the aforementioned structure in which the internal storage portion storing the activity pattern information is provided, the security device preferably further includes an activity pattern updating portion updating the activity pattern information on the basis of the information about the activity acquired through the first communication portion, and the abnormality determination portion is preferably formed to determine whether or not an abnormality is happening to the monitored person on the basis of the information about the activity acquired through the first communication portion and the activity pattern information updated by the activity pattern updating portion. According to this structure, the security system can more accurately determine whether or not an abnormality is happening to the monitored person on the basis of information more consistent with the actual activity state of the monitored person by employing the updated activity pattern information.

In the aforementioned structure in which the internal storage portion storing the activity pattern information is provided, the abnormality determination portion is preferably formed to determine that an abnormality is happening to the monitored person when a content of information about a prescribed activity acquired through the first communication portion and a content of information corresponding to the prescribed activity, of the activity pattern information are different from each other. According to this structure, the security system can easily determine that an abnormality is happening to the monitored person when the monitored person performs a behavior different from the activity pattern based on the history of the monitored person, which is a usual activity pattern of the monitored person.

In the aforementioned structure of determining that an abnormality is happening to the monitored person when the content of the information about the prescribed activity and the corresponding content of the activity pattern information are different from each other, the abnormality determination portion is preferably formed to determine that an abnormality is happening to the monitored person when a content of time information about the prescribed activity acquired through the first communication portion is not included within a prescribed range with respect to a content of time information corresponding to the prescribed activity, of the activity pattern information. According to this structure, the abnormality determination portion is allowed not to determine that an abnormality is happening to the monitored person if time difference is within the prescribed range, even when the monitored person performs a behavior different from the time-based activity pattern based on the history. Thus, the abnormality determination portion can be prevented from determining that an abnormality is happening to the monitored person simply from a small time deviation of the activity of the monitored person with respect to the usual activity pattern (activity pattern based on the history), and hence the security system can more accurately determine whether or not an abnormality is happening to the monitored person.

In the aforementioned structure of determining that an abnormality is happening to the monitored person when the content of the information about the prescribed activity and the corresponding content of the activity pattern information are different from each other, the security device preferably further includes a receiving portion confirming that an abnormality is not happening to the monitored person and receiving information that an abnormality is not happening to the monitored person when the content of the information about the prescribed activity acquired through the first communication portion and the content of the information corresponding to the prescribed activity, of the activity pattern information are different from each other, and the abnormality determination portion is preferably formed to determine that an abnormality is happening to the monitored person when the receiving portion has not receive the information that an abnormality is not happening to the monitored person. According to this structure, the receiving portion receives the information that the information that an abnormality is not happening to the monitored person, whereby the abnormality determination portion is allowed not to determine that an abnormality is happening to the monitored person in a case where an abnormality is not happening to the monitored person even when the monitored person performs a behavior different from the usual activity pattern (activity pattern based on the history). Thus, accuracy of determining whether or an abnormality is happening to the monitored person can be improved.

In the aforementioned structure in which the receiving portion is provided, the security device preferably further includes a display portion displaying a receiving screen for receiving the information that an abnormality is not happening to the monitored person, and the receiving portion is preferably formed to receive the information that an abnormality is not happening to the monitored person through the receiving screen displayed on the display portion. According to this structure, the monitored person can easily input the information that an abnormality is not happening to the monitored person by employing the receiving screen.

In the aforementioned structure in which the notification portion is provided, the abnormality determination portion is preferably formed to determine that the extent of the abnormality of the monitored person is at least critical or mild on the basis of the information about the activity acquired through the first communication portion, and the notification portion is preferably formed to transmit the information that an abnormality is happening to the monitored person and the information about the extent of the abnormality of the monitored person to notified parties in response to the extent of the abnormality of the monitored person through the second communication portion. According to this structure, the notified parties can take appropriate action depending on the extent of the occurring abnormality such that a specialized institution such as a medical emergency institution is notified when the extent of the abnormality of the monitored person is critical, and only a close related party such as a relative is notified when the extent of the abnormality of the monitored person is mild, for example.

In this case, the abnormality determination portion is preferably formed to determine the extent of the abnormality of the monitored person on the basis of a content of information about a prescribed activity acquired through the first communication portion and information about the length of stay of the monitored person in a prescribed place. According to this structure, the security system can easily determine the extent of the abnormality, thereby accurately determining the extent of the abnormality.

In the aforementioned security system according to the first aspect, the activity detection portion is preferably formed to detect information directly relating to the activity of the monitored person in the house and information about a state resulting indirectly from the activity of the monitored person in the house. According to this structure, the security system can determine whether or not an abnormality is happening to the monitored person and the extent of the abnormality from not only the direct information but also the indirect information such as the amount of electricity used, for example, thereby more accurately determining whether or not an abnormality is happening to the monitored person and the extent of the abnormality.

In this case, the activity detection portion is preferably formed to detect existence of the monitored person as the information directly relating to the activity of the monitored person in the house and detect at least one of the amounts of electricity, gas and water used as the information about the state resulting indirectly from the activity of the monitored person in the house. According to this structure, the security system can more accurately detect the activities of the monitored person on the basis of the detection result of the existence of the monitored person detected by the activity detection portion and the detection result of at least one of the amounts of electricity, gas and water used, thereby more accurately determining whether or not an abnormality is happening to the monitored person and the extent of the abnormality.

In the aforementioned structure in which the activity pattern updating portion is provided, the activity pattern updating portion is preferably formed to update the activity pattern information at prescribed intervals. According to this structure, the activity pattern updating portion updates the activity pattern information thereby obtaining the activity pattern information more consistent with the actual activity state of the monitored person during a prescribed period, and hence the security system can more accurately determine whether or not an abnormality is happening to the monitored person.

An electronic photo frame according to a second aspect of the present invention comprises a display portion capable of displaying an image on the basis of image data, a first communication portion acquiring information about an activity detected by an activity detection portion detecting the activity of a monitored person in a house, and an abnormality determination portion determining whether or not an abnormality is happening to the monitored person on the basis of the information about the activity acquired through the first communication portion and an activity history of the monitored person in the house and determining the extent of the abnormality of the monitored person on the basis of the information about the activity acquired through the first communication portion.

In the electronic photo frame according to the second aspect of the present invention, as hereinabove described, the abnormality determination portion determines whether or not an abnormality is happening to the monitored person on the basis of the information about the activity acquired through the first communication portion and the activity history of the monitored person in the house, whereby the security system can accurately determine whether or not an abnormality is happening to the monitored person on the basis of the activity history of the monitored person consistent with an actual activity state of the monitored person. Further, the abnormality determination portion determines the extent of the abnormality of the monitored person on the basis of the information about the activity acquired through the first communication portion, whereby the security system can determine not only that an abnormality is happening to the monitored person but also the state (extent) of the abnormality.

The aforementioned electronic photo frame according to the second aspect preferably further comprises an internal storage portion storing activity pattern information including information about a time-based activity based on the activity history of the monitored person, wherein the abnormality determination portion is formed to determine whether or not an abnormality is happening to the monitored person on the basis of the information about the activity acquired through the first communication portion and the activity pattern information and determine the extent of the abnormality of the monitored person on the basis of the information about the activity acquired through the first communication portion. According to this structure, the security system can determine whether or not an abnormality is happening to the monitored person on the basis of the information about the time-based activities, thereby accurately determining whether or not an abnormality is happening to the monitored person on the basis of information more consistent with the actual activity state of the monitored person.

In this case, the electronic photo frame according to the second aspect of the present invention preferably further comprises a second communication portion transmitting information to a third party previously registered other than the monitored person, and a notification portion transmitting information that an abnormality is happening to the monitored person and information about the extent of the abnormality of the monitored person through the second communication portion when the abnormality determination portion determines that the abnormality is happening to the monitored person. According to this structure, the third party receiving a notification can confirm not only that an abnormality is happening to the monitored person but also the extent of the abnormality, thereby taking action depending on the occurring abnormality.

In the aforementioned structure comprising the notification portion, the notification portion is preferably formed to switch notified parties to which the information that an abnormality is happening to the monitored person and the information about the extent of the abnormality of the monitored person are transmitted in response to a determination result of the extent of the abnormality of the monitored person determined by the abnormality determination portion. According to this structure, the notification portion can notify the notified parties (third parties) in response to the extent of the abnormality, and hence the notified parties can take more appropriate action depending on the extent of the occurring abnormality.

In the aforementioned structure comprising the notification portion, the second communication portion is preferably formed to be capable of communicating with an electronic device including an external storage portion, and the external storage portion is preferably formed to store the activity pattern information through the second communication portion on the basis of free space on the internal storage portion. According to this structure, the activity pattern information can be stored in the external storage portion even if the internal storage portion does not have enough free space.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 3 illustrates an activity/state pattern table of the security system according to the embodiment of the present invention;

FIG. 4 illustrates an abnormality extent determination table of the security system according to the embodiment of the present invention;

DESCRIPTION OF THE PREFERRED EMBODIMENTS

An embodiment of the present invention is now described with reference to the drawings.

First, the structure of a security system 100 according to an embodiment of the present invention is described with reference to FIGS. 1 to 4.

Figure 1:
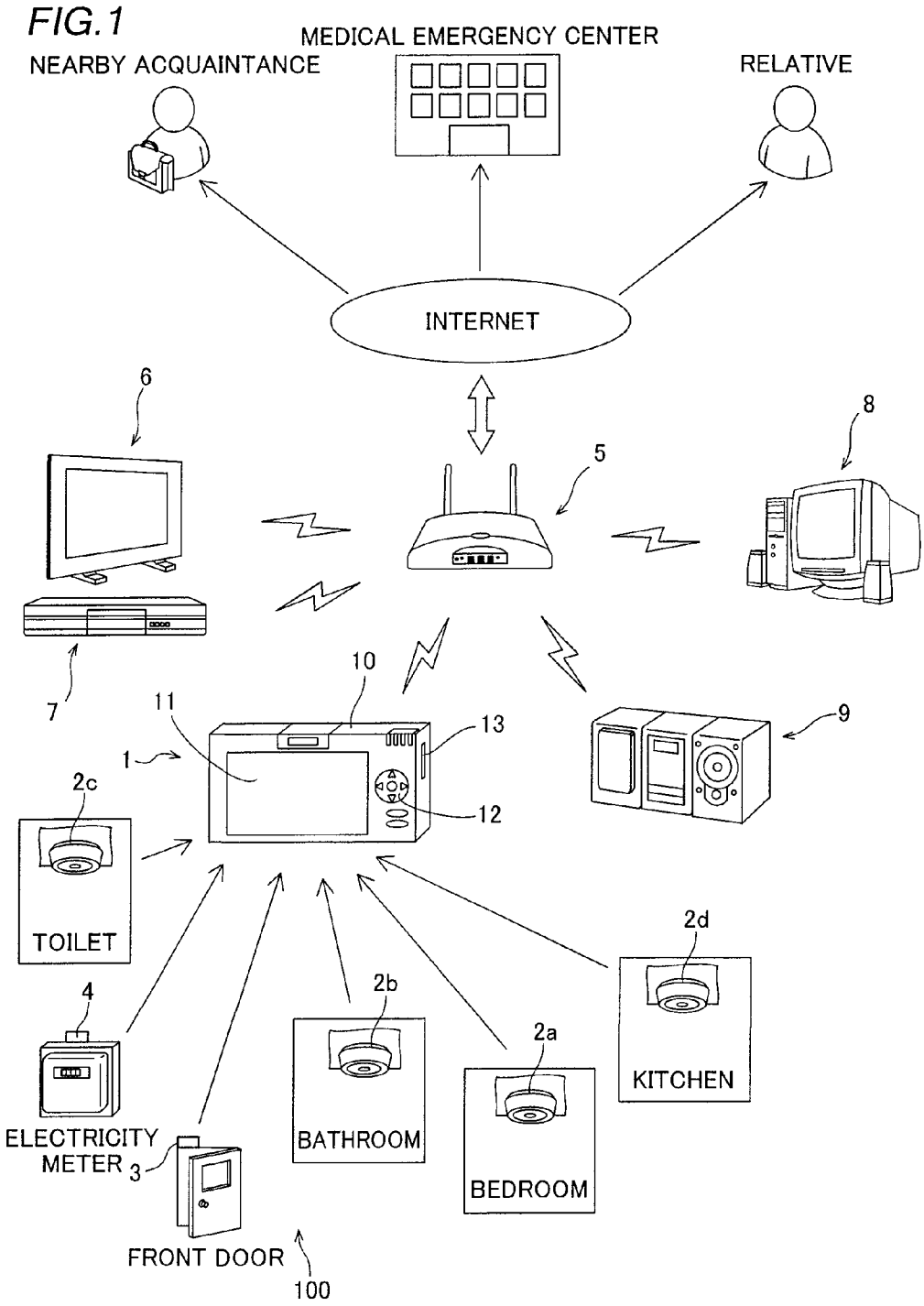
FIG. 1 schematically illustrates the structure of a security system according to an embodiment of the present invention.

The security system 100 according to the embodiment of the present invention comprises a digital photo frame 1, motion sensors 2*a*, 2*b*, 2*c* and 2*d*, a front door opening/closing sensor 3 and a current sensor 4, as shown in FIG. 1. The motion sensors 2*a* to 2*d*, the front door opening/closing sensor 3 and the current sensor 4 are connected to the digital photo frame 1 to be capable of communicating therewith. The digital photo frame 1 is an example of each of the "security device" and the "electronic photo frame" in the present invention. Each of the motion sensors 2*a* to 2*d*, the front door opening/closing sensor 3 and the current sensor 4 is an example of the "activity detection portion" in the present invention.

The digital photo frame 1 is connected to the Internet through a router 5, as shown in FIG. 1. Each of a digital television device 6, a DVD player 7, a PC (personal computer) 8 and an audio device 9 is also connected to the Internet through the router 5. A LAN (Local Area Network) serving as a home network is formed by the digital photo frame 1, the digital television device 6, the DVD player 7, the PC 8 and the audio device 9 through the router 5. In this case, the router 5 has a hub function enabling intercommunication over the home network formed by the LAN. The digital photo frame 1, the router 5, the digital television device 6, the DVD player 7, the PC 8 and the audio device 9 are placed in the same house.

Figure 2:
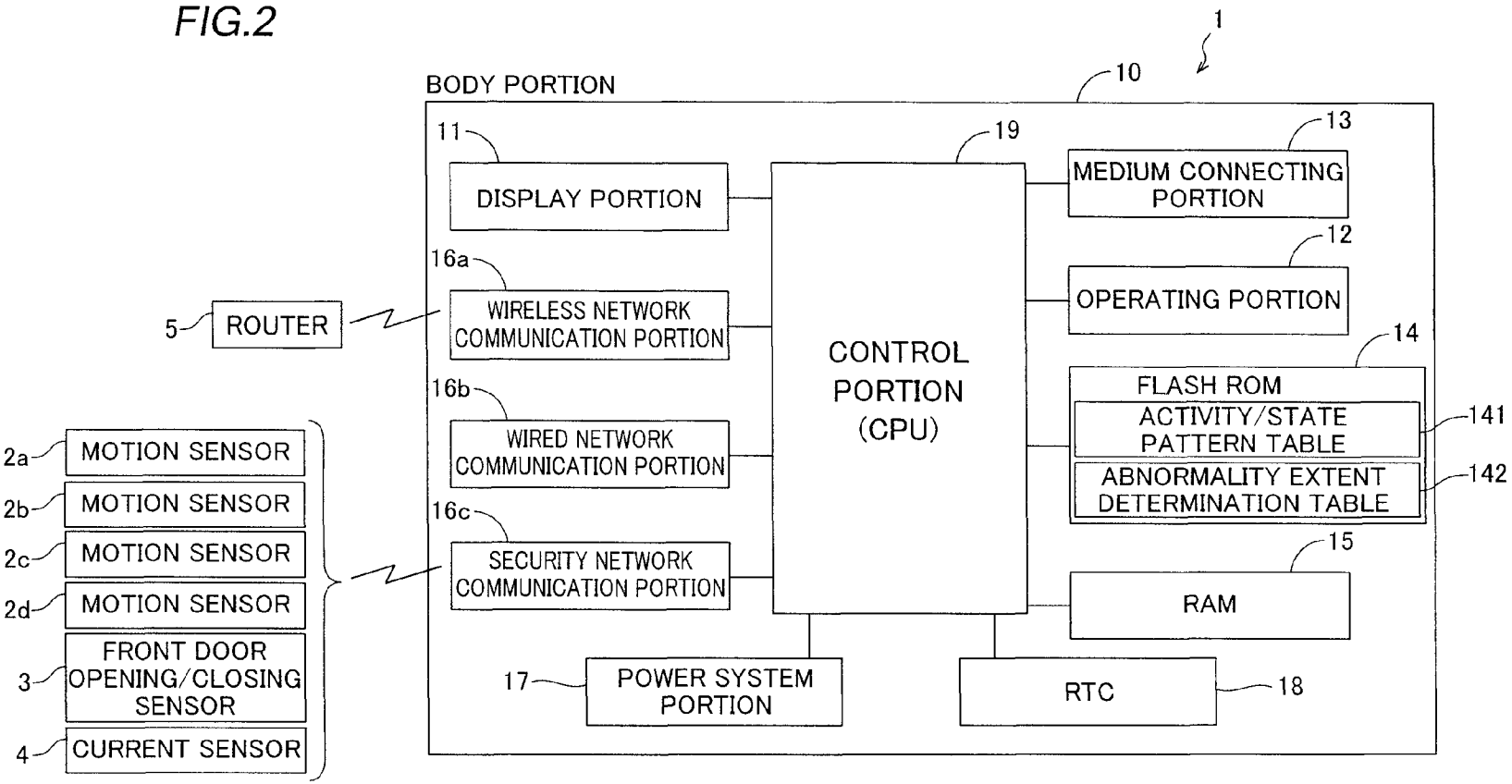
FIG. 2 is a block diagram showing the structure of a digital photo frame that the security system according to the embodiment of the present invention comprises.

The digital photo frame 1 comprises a body portion 10 having a rectangular shape in front elevational view, as shown in FIG. 1. A rectangular display portion 11 is provided on a front surface of the body portion 10. An operating portion 12 is arranged adjacent to the display portion 11 on the front surface of the body portion 10. A medium connecting portion 13 is provided on a side surface of the body portion 10. A flash ROM 14, a RAM 15, a wireless network communication portion 16*a*, a wired network communication portion 16*b*, a security network communication portion 16*c*, a power system portion 17, an RTC (Real Time Clock) 18 and a control portion (CPU) 19 are provided inside the body portion 10, as shown in FIG. 2.

The display portion 11 is formed by a liquid crystal display and is formed to be capable of displaying a digital image stored in a medium (not shown) connected to the medium connecting portion 13. The display portion 11 can display a setting screen for changing a display mode of an image and adjusting a color tone of an image and other various types of screens on the basis of an instruction from the control portion 19, as described later. The display mode of an image includes fixed display for displaying one image (photo image), slide show display for displaying a plurality of images (photo images), switching between the plurality of images at a prescribed interval, and time display.

The operating portion 12 is provided for selecting and determining an item displayed on various types of screens displayed on the display portion 11. A user can instruct deletion and copy of the digital image with the operating portion 12.

The medium connecting portion 13 is formed to be capable of correspond to various types of media, such as an SD memory card (Secure Digital Memory Card) (registered trademark), an xD picture card (registered trademark), a CF card (Compact Flash Card) (registered trademark) and a memory stick (registered trademark).

The flash ROM 14 is a rewritable nonvolatile memory and can store image data in the various types of media read through the medium connecting portion 13. The flash ROM 14 stores an activity/state pattern table 141 shown in FIG. 3 and an abnormality extent determination table 142 shown in FIG. 4. The flash ROM 14 is an example of the "internal storage portion" in the present invention.

The activity/state pattern table 141 includes a time-based activity pattern obtained on the basis of an activity history in a house of a monitored person, as shown in FIG. 3. The activity/state pattern table 141 also includes information about electrical usage per day obtained on the basis of the activity history in the house of the monitored person. More specifically, the activity/state pattern table 141 includes information about a plurality of detection times, detection positions at the respective detection times and activity contents corresponding to the detection positions. The information about the detection times and the detection positions is information obtained on the basis of the activity history in the house of the monitored person. These pieces of information are updated at prescribed intervals (weekly in this embodiment) on the basis of the activity history of the monitored person.

The activity/state pattern table 141 also includes time information indicating normal ranges. The normal ranges are acceptable ranges in which it is determined that it is normal when determining the possibility that an abnormality is happening to the monitored person by comparing a detection result obtained by each of the sensors (the motion sensors 2*a* to 2*d*, the front door opening/closing sensor 3 and the current sensor 4) with a content of the activity/state pattern table 141, as described later. In the exemplary activity/state pattern table 141 shown in FIG. 3, for example, the detection time is 6:30, the detection position (activity content) is a toilet (wake-up) and the normal range is ±1 hour, and hence the control portion 19 determines that it is normal in a case where the monitored person goes to the toilet between 5:30 (6:30-1 hour) and 7:30 (6:30+1 hour). As to the electrical usage per day, a normal range (acceptable range) of a quantity of electricity is provided. Values of the normal ranges can be set by the user depending on the respective activity contents. Further, the activity/state pattern table 141 includes information about the maximum lengths of stay in the toilet (wake-up) and a bathroom (bath). The activity/state pattern table 141 is an example of the "activity pattern information" in the present invention.

The abnormality extent determination table 142 includes information about determination conditions for determining extent of an abnormality being happening to the monitored person, as shown in FIG. 4. According to the embodiment, as described later, an abnormality of the monitored person is classified into three extents, which are critical, serious and mild, by the control portion 19. The control portion 19 determines that the abnormality is critical in a case where the monitored person stays in the bathroom or in the toilet for 2 or more hours and determines that the abnormality is serious in a case where the monitored person stays in the toilet for 1 or more hours. The control portion 19 determines that the abnormality is mild in a case of determining that an abnormality is happening to the monitored person and in a case other than the aforementioned critical and serious cases.

The RAM 15 is a volatile memory and is employed as a work area of the control portion 19.

The wireless network communication portion 16*a* is provided for performing wireless communication with the router 5. The body portion 10 can be connected to the networks (Internet and LAN) through the router 5 by being linked to the router 5 by a wireless connection through the wireless network communication portion 16*a*. The wireless network communication portion 16*a* is an example of the "second communication portion" in the present invention.

The wired network communication portion 16*b* is provided for performing wire communication with the router 5. According to the embodiment, the body portion 10 is linked to the router 5 by a wireless connection through the wireless network communication portion 16*a*, and the wired network communication portion 16*b* is not employed.

The security network communication portion 16*c* is provided for performing wireless communication with each of the sensors (the motion sensors 2*a* to 2*d*, the front door opening/closing sensor 3 and the current sensor 4). The body portion 10 acquires information about an activity of the monitored person detected by each of the sensors through the security network communication portion 16*c*. The security network communication portion 16*c* is an example of each of the "first communication portion" and the "communication portion" in the present invention.

The power system portion 17 has a function of supplying power to each part of the body portion 10. More specifically, the power system portion 17 is formed to switch to a state of not supplying power to each part of the body portion 10 (power-off state) or a state of supplying power to the entire body portion 10 (normal operation state) according to an instruction from the control portion 19.

The RTC 18 functions as a clock and is formed to continue to generate a current time in any of cases where the power system portion 17 is in the aforementioned states. In other words, the RTC 18 is formed to continue to operate in both of cases where the body portion 10 is in the power-off state and in the normal operation state. The RTC 18 is employed to acquire a current time when displaying a clock on the display portion 11.

The control portion 19 is formed by the CPU and is formed to control an operation of each part of the body portion 10 by running a computer program (not shown). The control portion 19 is formed to determine whether or not an abnormality is happening to the monitored person on the basis of the detection result (information about the activity of the monitored person) acquired from each of the sensors (the motion sensors 2*a* to 2*d*, the front door opening/closing sensor 3 and the current sensor 4) and the information in the activity/state pattern table 141, as described later. The control portion 19 is formed to determine the extent of the abnormality of the monitored person on the basis of the detection result (information about the activity of the monitored person) acquired from each of the sensors and the abnormality extent determination table 142. The control portion 19 has a function of notifying a previously set contact address of information that an abnormality is happening to the monitored person and information indicating the extent of the abnormality by employing E-mail (Electronic Mail) when determining that the abnormality is happening to the monitored person. This E-mail is sent to a prescribed contact address through the Internet. The control portion 19 is an example of each of the "abnormality determination portion", the "notification portion", the "activity pattern updating portion" and the "receiving portion" in the present invention.

The motion sensors 2*a* to 2*d* each have a function of detecting temperature change in a prescribed range by employing infrared rays. In other words, the motion sensors 2*a* to 2*d* detect temperature change when the monitored person moves into and out of the prescribed range, serving as information directly relating to the activities of the monitored person. The motion sensors 2*a* to 2*d* are formed to transmit the detection result to the digital photo frame 1. The motion sensor 2*a* is placed in a bedroom of the house and detects temperature change in the bedroom, and the motion sensor 2*b* is placed in the bathroom of the house and detects temperature change in the bathroom. The motion sensor 2*c* is placed in the toilet of the house and detects temperature change in the toilet, and the motion sensor 2*d* is placed in a kitchen of the house and detects temperature change in the kitchen.

The front door opening/closing sensor 3 is provided on a front door and has a function of detecting an opened/closed state of the front door. In other words, the front door opening/closing sensor 3 detects the opened/closed state when the monitored person enters and exits through the front door, serving as information directly relating to the activities of the monitored person. The front door opening/closing sensor 3 is formed to transmit the detection result to the digital photo frame 1.

The current sensor 4 is provided for detecting the amount of electricity used in the house. More specifically, the current sensor 4 is mounted on an electricity meter and is formed to detect electrical usage in the house. In other words, the current sensor 4 detects the monitored person's electrical usage in the house, serving as information about a state resulting indirectly from the activities of the monitored person in the house. The current sensor 4 is formed to transmit the detection result to the digital photo frame 1.

The router 5 is formed to function as a relay device connecting the digital photo frame 1, the digital television device 6, the DVD player 7, the PC 8 and the audio device 9 to the networks (Internet and LAN).

Next, abnormality determination processing of the security system 100 according to the embodiment of the present invention is described with reference to FIGS. 3, 5 and 6. According to the embodiment, the control portion 19 of the digital photo frame 1 runs the computer program (not shown) thereby executing the abnormality determination processing. The control portion 19 continuously executes the abnormality determination processing when the digital photo frame 1 is in the normal operation state.

The control portion 19 allows the body portion 10 to be in the normal operation state at a step S1 when the user turns on the body portion 10 of the digital photo frame 1. Thereafter, the control portion 19 retrieves the activity/state pattern table 141 from the flash ROM 14 at a step S2 and acquires the detection result from each of the sensors (the motion sensors 2*a* to 2*d*, the front door opening/closing sensor 3 and the current sensor 4) at a step S3. At this time, the control portion 19 retrieves the updated activity/state pattern table 141 in a case where the activity/state pattern table 141 has been updated, as described later.

According to the embodiment, the control portion 19 determines whether or not there is a possibility that an abnormality is happening to the monitored person at a step S4. More specifically, the control portion 19 determines whether or not the acquired detection result from each of the sensors and the content of the activity/state pattern table 141 are different from each other. In other words, the control portion 19 determines whether or not a prescribed activity of the monitored person is performed in a normal range (acceptable range) corresponding to a prescribed activity in the activity/state pattern table 141.

In the exemplary activity/state pattern table 141 shown in FIG. 3, for example, the detection time is 20:10 and the normal range is ±1 hour as to the bathroom (bath), and hence the control portion 19 determines whether or not the motion sensor 2*b* placed in the bathroom has detected movement of the monitored person to the bathroom between 19:10 (20:10−1 hour) and 21:10 (20:10+1 hour). In a case where the motion sensor 2*b* has not detected the movement, the control portion 19 determines that there is a possibility that an abnormality is happening to the monitored person. As to the bathroom (bath), the maximum length of stay is set to 2 hours, and hence the control portion 19 determines that there is a possibility that an abnormality is happening to the monitored person in a case where the length of stay of the monitored person in the bathroom exceeds 2 hours, even in a case where the motion sensor 2*b* has detected the movement of the monitored person to the bathroom between 19:10 (20:10−1 hour) and 21:10 (20:10+1 hour). As to the electrical usage, the control portion 19 determines whether or not the electrical usage per day is between 7 kWh (10 kWh−3 kWh) and 13 kWh (10 kWh+3 kWh) and determines that an abnormality is happening to the monitored person in a case where the electrical usage is outside the range.

Figure 6:
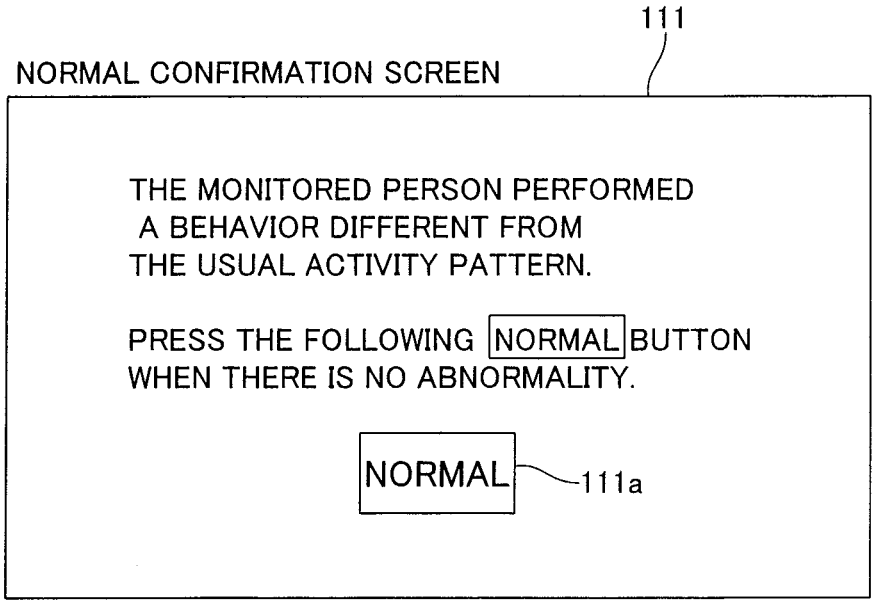
FIG. 6 illustrates a normal confirmation screen of the security system according to the embodiment of the present invention.

In a case where there is no possibility that an abnormality is happening to the monitored person (normal), the control portion 19 returns to the step S1, and in a case where there is possibility that an abnormality is happening to the monitored person, the control portion 19 displays a normal confirmation screen 111 shown in FIG. 6 on the display portion 11 at a step S5. The normal confirmation screen 111 includes messages saying that the monitored person performed a behavior different from a usual activity pattern and prompting the monitored person to press a normal button 111*a* indicating that an abnormality is not happening to the monitored person in a case where an abnormality is not happening to the monitored person. In a case where an abnormality is not happening to the monitored person, the monitored person can input information that an abnormality is not happening to the monitored person into the digital photo frame 1 by pressing the normal button 111*a*. The normal confirmation screen 111 is an example of the "receiving screen" in the present invention.

At a step S6, the control portion 19 determines whether or not the normal button 111*a* has been pressed, and in a case where the normal button 111*a* has been pressed, the control portion 19 determines whether or not the flash ROM 14 has enough free space at a step S7. In a case where the flash ROM 14 has enough free space, the control portion 19 stores information about the detection result acquired from each of the sensors, different from the content of the activity/state pattern table 141 in the flash ROM 14 at a step S8. In a case where the flash ROM 14 does not have enough free space, the control portion 19 stores the information about the detection result acquired from each of the sensors, different from the content of the activity/state pattern table 141 in a storage portion of the PC 8 at a step S9. At this time, the stored information is transmitted to the PC 8 through the LAN, and the PC 8 functions as a server. The PC 8 is an example of the "external storage portion" in the present invention.

The control portion 19 updates the activity/state pattern table 141 on the basis of the information stored in the flash ROM 14 and the PC 8 at a step S10. More specifically, the control portion 19 averages the information stored in the last one week and updates the activity/state pattern table 141 on the basis of the averaged information. In a case where movement of the monitored person to the toilet (wake-up) is at 8:30 on average in the last one week, for example, the control portion 19 changes the detection time of the toilet (wake-up) in the activity/state pattern table 141 from 6:30 to 8:30.

On the other hand, in a case where the normal button 111*a* is not pressed at the step S6, the control portion 19 determines whether or not a prescribed time period (10 minutes, for example) has elapsed since the normal confirmation screen 111 was displayed at a step S11. The control portion 19 repeats the steps S5, S6 and S11 until the monitored person presses the normal button 111*a* or the prescribed time period elapses. In a case where the prescribed time period elapses, the control portion 19 determines that an abnormality is happening to the monitored person at a step S12. In other words, in a case where the acquired detection result from each of the sensors and the content of the activity/state pattern table 141 are different from each other and the information that an abnormality is not happening to the monitored person has not been received within the prescribed time period, the control portion 19 determines that an abnormality is happening to the monitored person. Thereafter, the control portion 19 executes abnormality notification processing at a step S13.

Figure 5:
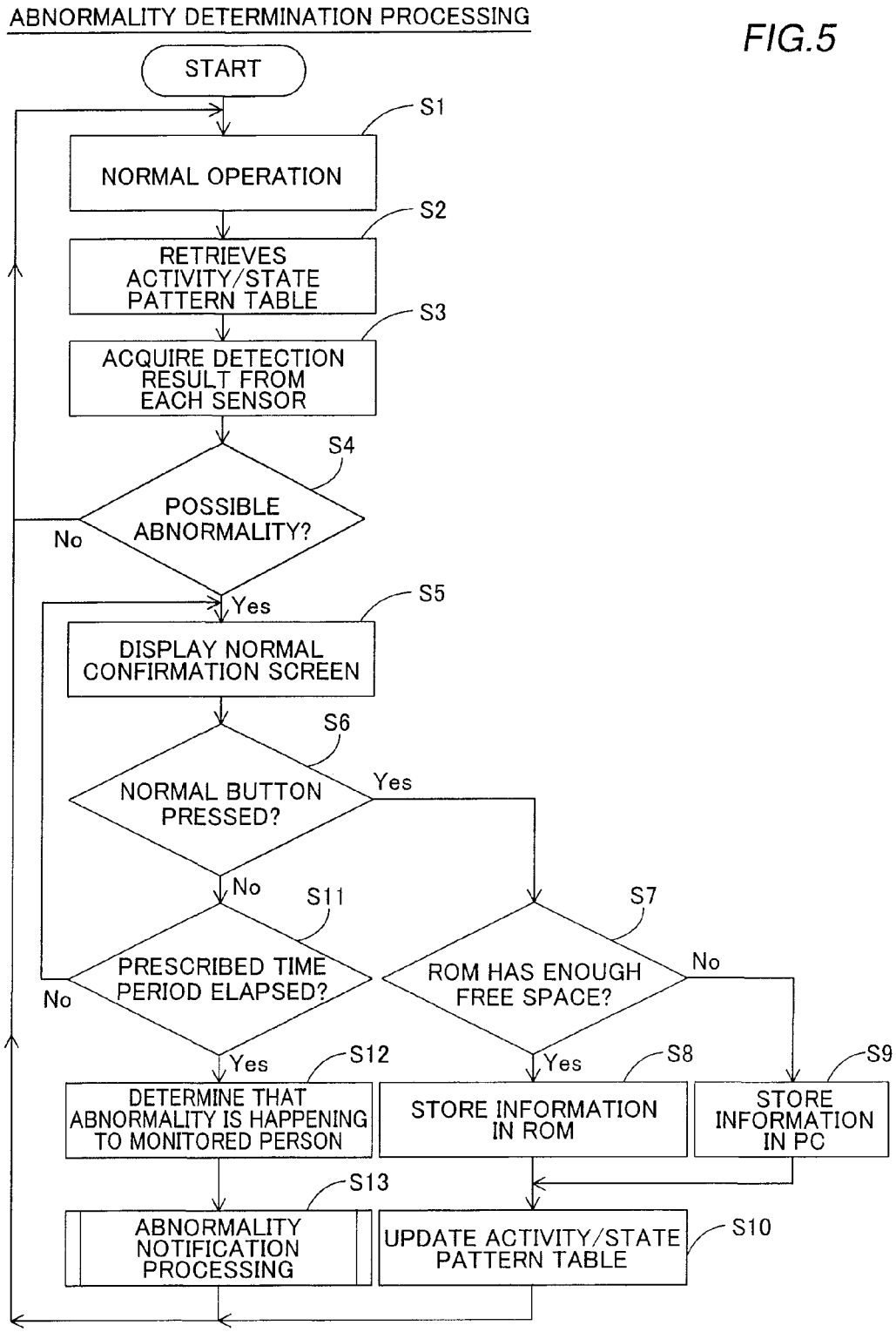
FIG. 5 is a flow chart for illustrating abnormality determination processing of the security system according to the embodiment of the present invention.

Next, the abnormality notification processing at the step S13 in FIG. 5 is described with reference to FIGS. 4 and 7.

At a step S131, the control portion 19 retrieves the abnormality extent determination table 142 from the flash ROM 14. The control portion 19 determines whether or not the extent of an abnormality of the monitored person is critical with reference to the detection result acquired from each of the sensors (the motion sensors 2*a* to 2*d*, the front door opening/closing sensor 3 and the current sensor 4) and the abnormality extent determination table 142 at a step S132. In a case where the monitored person stays in the bathroom or the toilet for 2 or more hours, the control portion 19 determines that the extent of the abnormality of the monitored person is critical and contacts a medical emergency center, a nearby acquaintance and a relative at steps S133, S134 and S135, respectively. More specifically, contact addresses of the emergency center, the nearby acquaintance and the relative are previously registered in the digital photo frame 1 as addresses of notified parties, and the control portion 19 sends E-mails to the emergency center, the nearby acquaintance and the relative through the Internet. The sent E-mails state that the abnormality is happening to the monitored person and the extent of the abnormality is critical.

In a case where the control portion 19 determines that the extent of the abnormality of the monitored person is not critical at the step S132, the control portion 19 determines whether or not the extent of the abnormality is serious at a step S136. In a case where the monitored person stays in the toilet for 1 or more hours, the control portion 19 determines that the extent of the abnormality of the monitored person is serious, and determines whether or not the prescribed notified parties have already been notified that the abnormality is serious at a step S137. Thus, the same notification can be prevented from being repeated. In a case where the prescribed notified parties have already been notified, the abnormality notification processing is terminated, and in a case where the prescribed notified parties have not yet been notified, the control portion 19 contacts the nearby acquaintance and the relative at steps S138 and S139, respectively. In this case, sent E-mails state that the abnormality is happening to the monitored person and the extent of the abnormality is serious.

In a case where the control portion 19 determines that the extent of the abnormality of the monitored person is not serious at the step S136, the control portion 19 determines whether or not the prescribed notified parties have already been notified that the abnormality is mild at a step S140. In a case where the prescribed notified parties have already been notified, the abnormality notification processing is terminated, and in a case where the prescribed notified parties have not yet been notified, the control portion 19 contacts only the relative at a step S141. In this case, a sent E-mail states that the abnormality is happening to the monitored person and the extent of the abnormality is mild.

Figure 7:
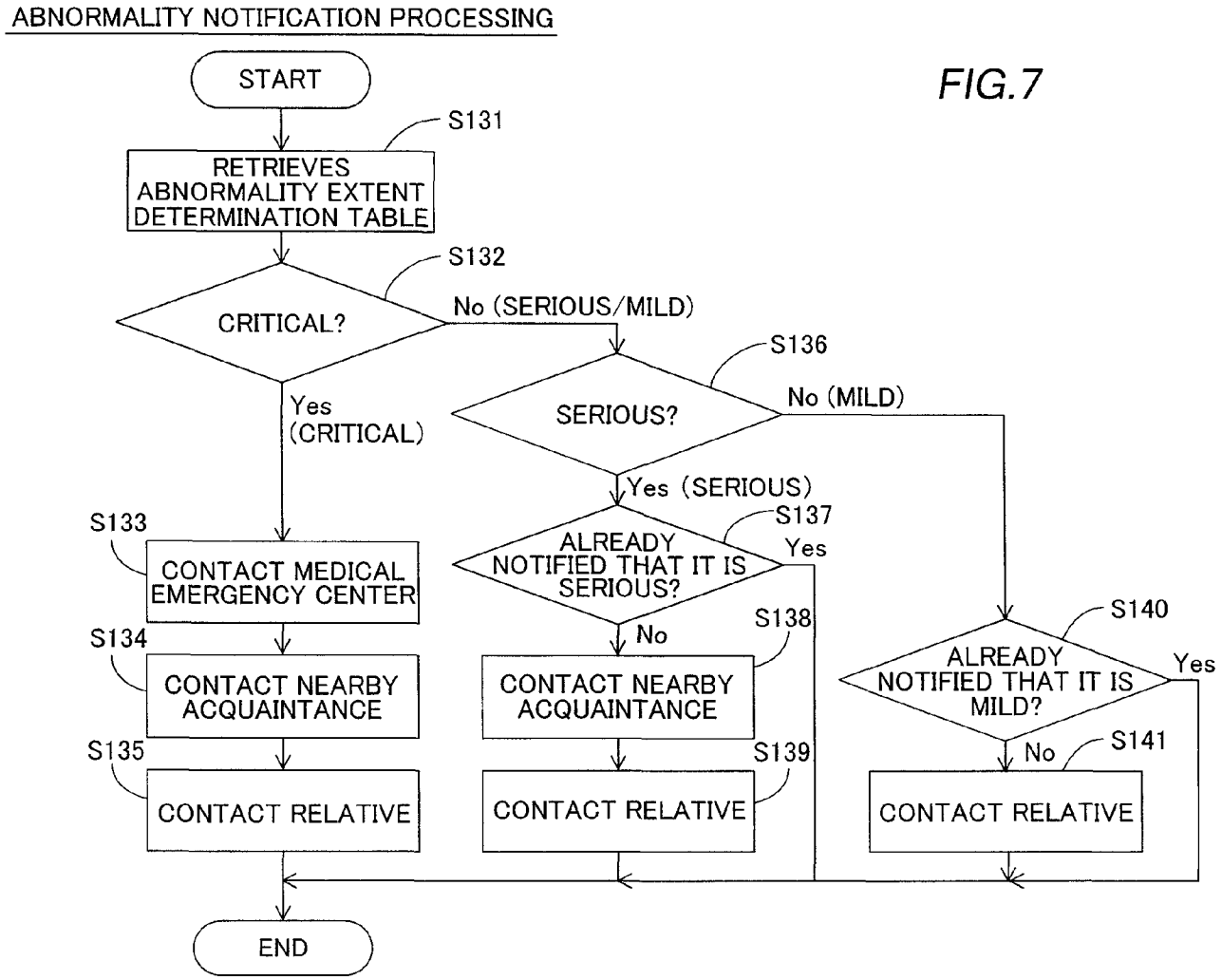
FIG. 7 is a flow chart for illustrating abnormality notification processing at a step S13 of the abnormality determination processing shown in FIG. 5.

When the abnormality notification processing shown in FIG. 7 is terminated, the control portion 19 returns to the step S1 and continues the abnormality determination processing.

According to this embodiment, as hereinabove described, the control portion 19 determines whether or not an abnormality is happening to the monitored person on the basis of the detection result (information about the activity) acquired through the security network communication portion 16*c* and the activity history in the house of the monitored person, whereby the control portion 19 can accurately determine whether or not an abnormality is happening to the monitored person on the basis of the activity history of the monitored person consistent with an actual activity state of the monitored person. Further, the control portion 19 determines the extent of the abnormality of the monitored person on the basis of the detection result (information about the activity) acquired through the security network communication portion 16*c*, whereby the control portion 19 can determine not only that an abnormality is happening to the monitored person but also the state (extent) of the abnormality.

According to this embodiment, the control portion 19 determines whether or not an abnormality is happening to the monitored person on the basis of the detection result (information about the activity) acquired through the security network communication portion 16*c* and the activity/state pattern table 141 including information about time-based activities based on the activity history of the monitored person and determines the extent of the abnormality of the monitored person on the basis of the detection result (information about the activity) acquired through the security network communication portion 16*c*, whereby the control portion 19 can determine whether or not an abnormality is happening to the monitored person on the basis of the information about the time-based activities, and hence the control portion 19 can accurately determine whether or not an abnormality is happening to the monitored person on the basis of information more consistent with the actual activity state of the monitored person.

According to this embodiment, the control portion 19 notifies third parties (the medical emergency center, the nearby acquaintance and the relative) of information that an abnormality is happening to the monitored person and information about the extent of the abnormality of the monitored person through the wireless network communication portion 16*a* when determining that an abnormality is happening to the monitored person, whereby the third parties receiving the notification can confirm not only that an abnormality is happening to the monitored person but also the extent of the abnormality, and hence the third parties can take action depending on the occurring abnormality.

According to this embodiment, the notified parties are switched in response to the determination result of the extent of the abnormality of the monitored person determined by the control portion 19, whereby the notified parties (third parties) in response to the extent of the abnormality can be notified, thereby taking more appropriate action depending on the extent of the occurring abnormality.

According to this embodiment, the control portion 19 updates the activity/state pattern table 141 on the basis of the detection result (information about the activity) acquired through the security network communication portion 16*c*, whereby the control portion 19 can accurately determine whether or not an abnormality is happening to the monitored person on the basis of the information more consistent with the actual activity state of the monitored person.

According to this embodiment, the control portion 19 determines that an abnormality is happening to the monitored person when a detection result of a prescribed activity acquired through the security network communication portion 16*c* and the content corresponding to the prescribed activity, of the activity/state pattern table 141 are different from each other, whereby the control portion 19 can easily determine that an abnormality is happening to the monitored person when the monitored person performs a behavior different from the activity pattern based on the history of the monitored person, which is a usual activity pattern of the monitored person.

According to this embodiment, the control portion 19 determines that an abnormality is happening to the monitored person when a detection result of a prescribed activity acquired through the security network communication portion 16*c* and the content corresponding to the prescribed activity, of the activity/state pattern table 141 are different from each other and the information that an abnormality is not happening to the monitored person has not been received, thereby allowing the control portion 19 not to determine that an abnormality is happening to the monitored person by receiving the information that an abnormality is not happening to the monitored person in a case where an abnormality is not happening to the monitored person, even when the monitored person performs a behavior different from the usual activity pattern (activity pattern based on the history). Thus, accuracy of determining whether or an abnormality is happening to the monitored person can be improved.

According to this embodiment, the control portion 19 determines the extent of the abnormality of the monitored person on the basis of a content of information of a prescribed activity acquired through the security network communication portion 16*c* and information of the length of stay of the monitored person in a prescribed place. Thus, the control portion 19 can easily determine the extent of the abnormality, thereby accurately determining the extent of the abnormality.

According to this embodiment, the motion sensors 2*a* to 2*d* and the front door opening/closing sensor 3 detect the information directly relating to the activities of the monitored person in the house, and the current sensor 4 detects the information about the state resulting indirectly from the activities of the monitored person in the house. Thus, the control portion 19 can determine whether or not an abnormality is happening to the monitored person and the extent of the abnormality from not only the direct information but also the indirect information such as the amount of electricity used, thereby more accurately determining whether or not an abnormality is happening to the monitored person and the extent of the abnormality.

According to this embodiment, the motion sensors 2*a* to 2*d* and the front door opening/closing sensor 3 detect existence of the monitored person as the information directly relating to the activities of the monitored person in the house, and the current sensor 4 detects at least one of the amounts of electricity, gas and water used as the information about the state resulting indirectly from the activities of the monitored person in the house. Thus, the activities of the monitored person can be more accurately detected on the basis of the detection results of the existence of the monitored person detected by the motion sensors 2*a* to 2*d* and the front door opening/closing sensor 3 and the detection result of at least one of the amounts of electricity, gas and water used detected by the current sensor 4, and hence the control portion 19 can more accurately determine whether or not an abnormality is happening to the monitored person and the extent of the abnormality.

According to this embodiment, the control portion 19 updates the activity/state pattern table 141 at the prescribed intervals. Thus, the control portion 19 updates the activity/state pattern table 141 thereby obtaining the activity/state pattern table 141 more consistent with the actual activity state of the monitored person during a prescribed period, and hence the control portion 19 can more accurately determine whether or not an abnormality is happening to the monitored person.

Although the present invention has been described and illustrated in detail, it is clearly understood that the same is by way of illustration and example only and is not to be taken by way of limitation, the spirit and scope of the present invention being limited only by the terms of the appended claims.

For example, while the digital photo frame is shown as an exemplary security device in the aforementioned embodiment, the present invention is not restricted to this, but another electronic device other than the digital photo frame may be employed as a security device. At this time, an electronic device usually kept in an always-normal operation state (power-on state), such as a digital photo frame is preferably employed as a security device.

While the motion sensors, the front door opening/closing sensor and the current sensor are shown as exemplary activity detection portions in the aforementioned embodiment, the present invention is not restricted to this, but a detection device detecting a viewing status of a television, a monitoring camera imaging the monitored person or the like may be employed, for example, so far as the information about the activity of the monitored person in the house can be acquired.

While a total of six activity detection portions, which are four motion sensors, one front door opening/closing sensor and one current sensor, are provided in the aforementioned embodiment, the present invention is not restricted to this, but only one activity detection portion may be provided, or more than six activity detection portions may be provided, for example. At this time, the activity detection portions to be provided may be a combination of different types of activity detection portions or may be constituted by one type of activity detection portions such as only a plurality of motion sensors, for example.

While the current sensor detecting the amount of electricity used is provided as the activity detection portion detecting the information about the state resulting indirectly from the activities of the monitored person in the house in the aforementioned embodiment, the present invention is not restricted to this. An activity detection portion for detecting the amount of gas used may be provided, or an activity detection portion for detecting the amount of water used may be provided, for example. Alternatively, a plurality of activity detection portions may be provided. At this time, the activity detection portions to be provided may be a combination of different types of activity detection portions or may be constituted by one type of activity detection portions such as only a plurality of current sensors, for example.

While the control portion serving as the notification portion notifies the previously set contact address of the information that an abnormality is happening to the monitored person and the extent of the abnormality by employing E-mail in the aforementioned embodiment, the present invention is not restricted to this, but another method other than E-mail, such as voice mail notifying others by voice may be employed to notify others, for example. Alternatively, a method (E-mail, voice mail or the like) to notify others may be switched in response to the notified parties or the extent of the abnormality.

While the control portion serving as the notification portion is formed to notify the previously set contact address of the information that an abnormality is happening to the monitored person and the extent of the abnormality in the aforementioned embodiment, the present invention is not restricted to this, but the control portion serving as the communication portion may be formed to notify the previously set contact address of only the information that an abnormality is happening to the monitored person.

While the medical emergency center, the nearby acquaintance and the relative are registered as the notified parties in the aforementioned embodiment, the present invention is not restricted to this, but another party other than the aforementioned three parties, such as a security company may be registered as a notified party, for example. Alternatively, less than three parties or more than three parties may be registered as notified parties.

While the control portion is formed to switch the notified parties in response to the extent of the abnormality in the aforementioned embodiment, the present invention is not restricted to this, but the control portion may be formed to switch only contents of the notification in response to the extent of the abnormality without switching the notified parties.

While the control portion serving as the receiving portion is formed to receive the information that an abnormality is not happening to the monitored person through the normal confirmation screen serving as the receiving screen in the aforementioned embodiment, the present invention is not restricted to this, but the control portion may be formed to receive the information that an abnormality is not happening to the monitored person without involving the receiving screen. In this case, the control portion may be formed to receive the information that an abnormality is not happening to the monitored person when the monitored person is notified that the monitored person performed an unusual behavior by sound and presses a prescribed button provided on a body of the digital photo frame, for example.

While the control portion serving as the abnormality determination portion is formed to classify the extent of the abnormality into three degrees, which are critical, serious and mild, in the aforementioned embodiment, the present invention is not restricted to this, but the control portion may be formed to classify the extent of the abnormality into two degrees, which are critical and mild, or more than three degrees.

While the activity/state pattern table about single-day activities is shown as an exemplary activity pattern information in the aforementioned embodiment, the present invention is not restricted to this, but activity pattern information about week-long activities or activity pattern information varying depending on a day of the week may be employed.

While the control portion is formed to update the activity/state pattern table serving as the activity pattern information on the basis of the averaged information in the last one week in the aforementioned embodiment, the present invention is not restricted to this, but the control portion may be formed to update the activity/state pattern table on the basis of information in each day or ten days of information other than one week, for example.

While the control portion is formed to determine the extent of the abnormality by employing the length of stay in the bathroom or the toilet in the aforementioned embodiment, the present invention is not restricted to this, but the control portion may be formed to determine the extent of the abnormality by employing the length of stay in another place of the house.

While the control portion is formed to determine the extent of the abnormality of the monitored person by employing the abnormality extent determination table in the aforementioned embodiment, the present invention is not restricted to this, but the control portion may be formed to determine the extent of the abnormality without employing the abnormality extent determination table.

While the activity/state pattern table serving as the activity pattern information is stored in the flash ROM (internal storage portion) of the digital photo frame (security device) in the aforementioned embodiment, the present invention is not restricted to this, but the activity/state pattern table may be stored in the PC serving as the external storage portion on the basis of free space on the internal storage portion.

What is claimed is:

1. A security system comprising:

an activity detection portion which is provided in a predetermined area detecting predetermined information of a monitored person; and a security device including a first communication portion acquiring said predetermined information, and an abnormality determination portion determining a level of the abnormality of said monitored person based on said predetermined information, an activity history of said monitored person and an extent determination information, said security device further includes a second communication portion transmitting information to a third party previously registered other than said monitored person and a notification portion transmitting information that an abnormality is happening to said monitored person and information about a level of the abnormality of said monitored person through said second communication portion when said abnormality determination portion determines that the abnormality is happening to said monitored person, and said notification portion is configured to switch notified parties to which the information that the abnormality is happening to said monitored person and the information about the level of the abnormality of said monitored person are transmitted in response to a determination result of the level of the abnormality of said monitored person determined by said abnormality determination portion.

2. The security system according to claim 1, wherein said security device further includes an internal storage portion storing activity pattern information related to an activity and a time, including information about a time-based activity based on said activity history of said monitored person, and said abnormality determination portion is formed to determine whether or not an abnormality is happening to said monitored person based on said predetermined information about the activity acquired through said first communication portion and said activity pattern information and determine the level of the abnormality of said monitored person based on said predetermined information about the activity acquired through said first communication portion and an abnormality extent determination table including said extent determination information.

3. The security system according to claim 1, wherein said second communication portion is formed to be capable of communicating with an electronic device including an external storage portion, and said external storage portion is formed to store said activity pattern information through said second communication portion based on free space on said internal storage portion of said security device.

4. The security system according to claim 2, wherein said security device further includes an activity pattern updating portion updating said activity pattern information based on said information about the activity acquired through said first communication portion, and said abnormality determination portion is formed to determine whether or not an abnormality is happening to said monitored person based on said predetermined information about the activity acquired through said first communication portion and said activity pattern information updated by said activity pattern updating portion.

5. The security system according to claim 2, wherein said abnormality determination portion is formed to determine that an abnormality is happening to said monitored person when a content of information about a prescribed activity acquired through said first communication portion and a content of information corresponding to said prescribed activity, of said activity pattern information are different from each other.

6. The security system according to claim 5, wherein said abnormality determination portion is formed to determine that an abnormality is happening to said monitored person when a content of time information about said prescribed activity acquired through said first communication portion is not included within a prescribed range with respect to a content of time information corresponding to said prescribed activity, of said activity pattern information.

7. The security system according to claim 5, wherein said security device further includes a receiving portion confirming that an abnormality is not happening to said monitored person and receiving information that an abnormality is not happening to said monitored person when the content of the information about said prescribed activity acquired through said first communication portion and the content of the information corresponding to said prescribed activity, of said activity pattern information are different from each other, and said abnormality determination portion is formed to determine that an abnormality is happening to said monitored person when said receiving portion has not receive the information that an abnormality is not happening to said monitored person.

8. The security system according to claim 7, wherein said security device further includes a display potion displaying a receiving screen for receiving the information that an abnormality is not happening to said monitored person, and said receiving portion is formed to receive the information that an abnormality is not happening to said monitored person through said receiving screen displayed on said display portion.

9. The security system according to claim 1, wherein said abnormality determination portion is formed to determine that the level of the abnormality of said monitored person is at least critical or mild based on said information about the activity acquired through said first communication portion, and said notification portion is formed to transmit the information that an abnormality is happening to said monitored person and the information about the level of the abnormality of said monitored person to notified parties in response to the level of the abnormality of said monitored person through said second communication portion.

10. The security system according to claim 9, wherein said abnormality determination portion is formed to determine the level of the abnormality of said monitored person based on a content of information about a prescribed activity acquired through said first communication portion and information about the length of stay of said monitored person in a prescribed place.

11. The security system according to claim 1, wherein said activity detection portion is formed to detect information directly relating to the activity of said monitored person in the house and information about a state resulting indirectly from the activity of said monitored person in the house.

12. The security system according to claim 11, wherein said activity detection portion is formed to detect existence of said monitored person as the information directly relating to the activity of said monitored person in the house and detect at least one of the amounts of electricity, gas and water used as the information about the state resulting indirectly from the activity of said monitored person in the house.

13. The security system according to claim 4, wherein said activity pattern updating portion is formed to update said activity pattern information at prescribed intervals.

14. An electronic photo frame comprising:

a display portion capable of displaying an image based on image data;

a first communication portion acquiring predetermined information about an activity detected by an activity detection portion, which is provided in a predetermined area, detecting said predetermined information of a monitored person;

an abnormality determination portion determining a level of the abnormality of said monitored person based on said predetermined information, an activity history of said monitored person and an extent determination information a second communication portion transmitting information to a third party previously registered other than said monitored person; and a notification portion transmitting information that an abnormality is happening to said monitored person and information about a level of the abnormality of said monitored person through said second communication portion when said abnormality determination portion determines that the abnormality is happening to said monitored person, wherein said notification portion is formed to switch notified parties to which the information that an abnormality is happening to said monitored person and the information about the level of the abnormality of said monitored person are transmitted in response to a determination result of the level of the abnormality of said monitored person determined by said abnormality determination portion.

15. The electronic photo frame according to claim 14, further comprising an internal storage portion storing activity pattern information related to the activity and a time, including information about a time-based activity based on said activity history of said monitored person, wherein said abnormality determination portion is formed to determine whether or not an abnormality is happening to said monitored person based on said predetermined information about the activity acquired through said first communication portion and said activity pattern information and determine the level of the abnormality of said monitored person based on said predetermined information about the activity acquired through said first communication portion and an abnormality extent determination table including said extent determination information.

16. The electronic photo frame according to claim 14, wherein said second communication portion is formed to be capable of communicating with an electronic device including an external storage portion, and said external storage portion is formed to store said activity pattern information through said second communication portion based on free space on said internal storage portion.

* * * * *